US007492276B2

(12) United States Patent
Fayfield

(10) Patent No.: US 7,492,276 B2
(45) Date of Patent: Feb. 17, 2009

(54) MICRO-PROCESSOR CONTROLLED INDICATOR DEVICE

(75) Inventor: Robert W. Fayfield, Excelsior, MN (US)

(73) Assignee: Banner Engineering Corporation, Minneapolis, MN (US)

( * ) Notice: Subject to any disclaimer, the term of this patent is extended or adjusted under 35 U.S.C. 154(b) by 208 days.

(21) Appl. No.: 11/317,991

(22) Filed: Dec. 22, 2005

(65) Prior Publication Data

US 2007/0152842 A1 Jul. 5, 2007

(51) Int. Cl.
*G09F 9/35* (2006.01)

(52) U.S. Cl. ..... 340/815.45; 340/286.01; 362/227; 362/555; 362/800

(58) Field of Classification Search ..... 340/815.45
See application file for complete search history.

(56) References Cited

U.S. PATENT DOCUMENTS

| | | | | |
|---|---|---|---|---|
| 4,157,486 | A * | 6/1979 | Fegley | 315/71 |
| D363,036 | S * | 10/1995 | Sasaki | D10/114 |
| 5,963,126 | A * | 10/1999 | Karlin et al. | 340/321 |
| 7,385,359 | B2 * | 6/2008 | Dowling et al. | 315/292 |
| 2003/0030567 | A1 * | 2/2003 | Hetzel et al. | 340/815.4 |
| 2004/0166743 | A1 * | 8/2004 | Kurose et al. | 439/701 |
| 2006/0044814 | A1 * | 3/2006 | Ikeda | 362/382 |

OTHER PUBLICATIONS

Oracle, Application Server Wirelss Admistrator's Guide, Dec. 2004, pp. 4.6-4.15.*

"50mm Stack Lights," Allen-Bradley Product Profile, 15 pages (Feb. 2001).

"Bertech Industrial Environments," http://www.bertech.com.au/signal_towers.htm, 2 pages (Date Printed Mar. 29, 2004).

"ClickAutomation.com," http://www.clickautomation.com/products/index.php?func=list&cid=197, 2 pages (Date Printed Mar. 9, 2005).

"Edwards Signaling Products," Newark Electronics, pp. 858, 859, 941, 1505, and 1506, date unknown.

"Indicating Banks and Accessories," Newark Electronics, p. 856, date unknown.

"Patlite Corporation—Brackets," http://www.patlite.com/access/bracket.htm, 13 pages (Copyright 1998).

"Patlite Corporation—PHE-3FB PC-Controlled Light," http://www.patlite.com/visible/phe.htm, 9 pages (Copyright 1999).

"Patlite Corporation—Visible Lighting Products," http://www.patlite.com/visible.htm, 2 pages (Date Printed Mar. 31, 2004).

"Stackable Beackons; Visual Signals," http://www.oksolar.com/visual_signals/stackable_beackons, 4 pages (Date Printed Mar. 30, 2004).

"Stacklights," *Cutler-Hammer*, vol. 2, Ref. No. 0863, pp. 46-1-46-14 (Jan. 2003).

* cited by examiner

*Primary Examiner*—George A Bugg
(74) *Attorney, Agent, or Firm*—Merchant & Gould P.C.

(57) ABSTRACT

An indicator device includes an indicator module, a control module, and a communications module. The indicator module is configured to emit a plurality of light signals. The control module is operationally coupled to the indicator module and is configured to operate the indicator module based on one of a plurality of logic functions stored in the control section. The communications module is operationally coupled to the control section and is configured to receive an input signal corresponding to one of the logic functions.

20 Claims, 8 Drawing Sheets

MICRO-PROCESSOR CONTROLLED INDICATOR DEVICE

TECHNICAL FIELD

The present invention relates to indicators, and more particularly to multi-colored light indicators used in factory automation.

BACKGROUND

Indicators, such as light indicators, are generally used in factory automation to indicate the operating status of a machine. An example of these light indicators are often called POST LIGHTS™ or STACKLIGHTS™. The name refers to the configuration of the light indicator since it usually includes a plurality of colored light sources stacked one on top of the other in a post formation. For example, the indicator may consist of a red light stacked on top of a yellow light stacked on top of a green light, similar to a traffic semaphore. These indicators illuminate depending on an input signal supplied to the indicator. This type of indicator is generally mounted high on a machine to indicate whether it is running, stopped, or in a trouble condition.

Typically, the lights in the indicator are illuminated by supplying a voltage to each light, causing the light to remain lit for as long as the voltage continues to be applied to the light. Many of these light indicators are hardwired to include a flasher for causing one or more of the lights to flash. The wiring is typically located inside the device and is not changed during operation.

These types of light indictors have disadvantages. One such disadvantage is that an electrician is required to wire them. Another such disadvantage is that the lights are usually quite large. Therefore, improvements are desirable.

SUMMARY

One example embodiment of the present invention is an indicator device including an indicator module, a control module, and a communications module. The indicator module is configured to emit a plurality of light signals. The control module is operationally coupled to the indicator module and is configured to operate the indicator module based on one of a plurality of logic functions stored in the control section. The communications module is operationally coupled to the control section and is configured to receive an input signal corresponding to one of the logic functions.

Another possible embodiment of the invention includes a microcontroller, multiple input lines, and multiple light indicators. The microcontroller is configured to store a plurality of programs. The input lines are operationally coupled to the microcontroller for sending one of a plurality of input signals to the microcontroller. Each input signal activates one of the programs stored in the microcontroller. The light indicators are operationally coupled to the microcontroller for receiving a control signal from the microcontroller. The control signal causes the light indicator to emit one of a plurality of light functions. The microcontroller transmits the control signal to each light indicator based on the activated program.

Yet another example embodiment of the invention includes a communication line having a first end in communication with a microcontroller and a second end in communication with a program source. The program source is used to alter the programs stored in the microcontroller so that a different function may be associated with each combination of input lines. This allows the invention to be reprogrammed without having to open up or dismantle the invention.

BRIEF DESCRIPTION OF THE DRAWINGS

Referring now to the drawings in which like reference numbers represent corresponding parts throughout.

DETAILED DESCRIPTION

In general, the present disclosure is related to an indicator device for indicating the status of a machine, process, or the like. Preferably, the indicator device includes an indicator section, a connector section (also referred to as a communications section), and a mounting section (also referred to as a control section). The indicator section is arranged and configured to emit light of one or more colors. The connector section is arranged to receive an input element, such as a wiring harness. The mounting section is arranged and configured for easy mounting of the indicator. Typically, housed within the mounting section is a logic circuit. Preferably, data signals are received by the logic circuit from the connector section. The logic circuit instructs the indicator section to display a certain light function based on the data signal received. Examples of some light functions include solid colors, blended colors, flashing colors, dimmed colors, or alternating colors. The time of display of these light functions can be varied as well. Other suitable light functions can also be used.

Figure 1A:
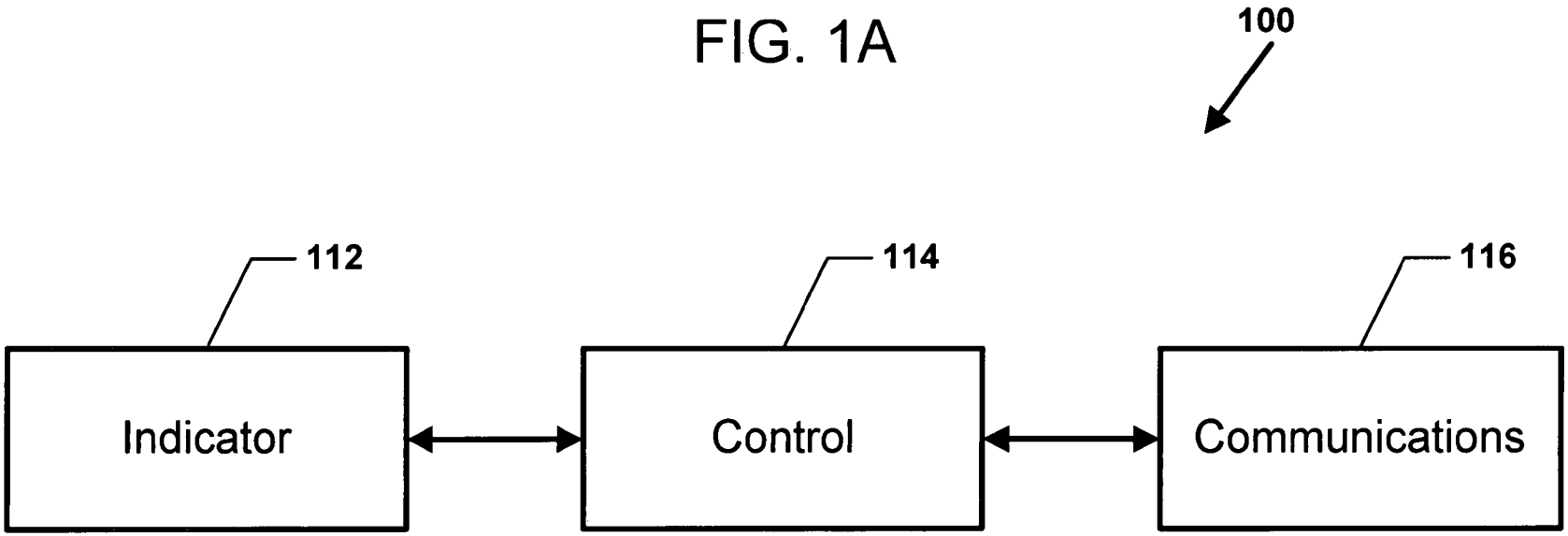
FIG. 1A is a block diagram of an indicator device, according to an exemplary embodiment of the present disclosure.

Referring now to the figures, FIG. 1A is a block diagram of an indicator device 100, according to one example embodiment. The indicator device 100 includes an indicator module 112, a control module 114, and a communications module 116. The indicator module 112 is configured to emit a plurality of light signals. The control module 114 is operationally coupled to the indicator module 112 and is configured to operate the indicator module 112 based on one of a plurality of logic functions stored in the control section 114. The communications module 116 is operationally coupled to the control section 114 and is configured to receive an input signal corresponding to one of the logic functions.

Figure 1B:
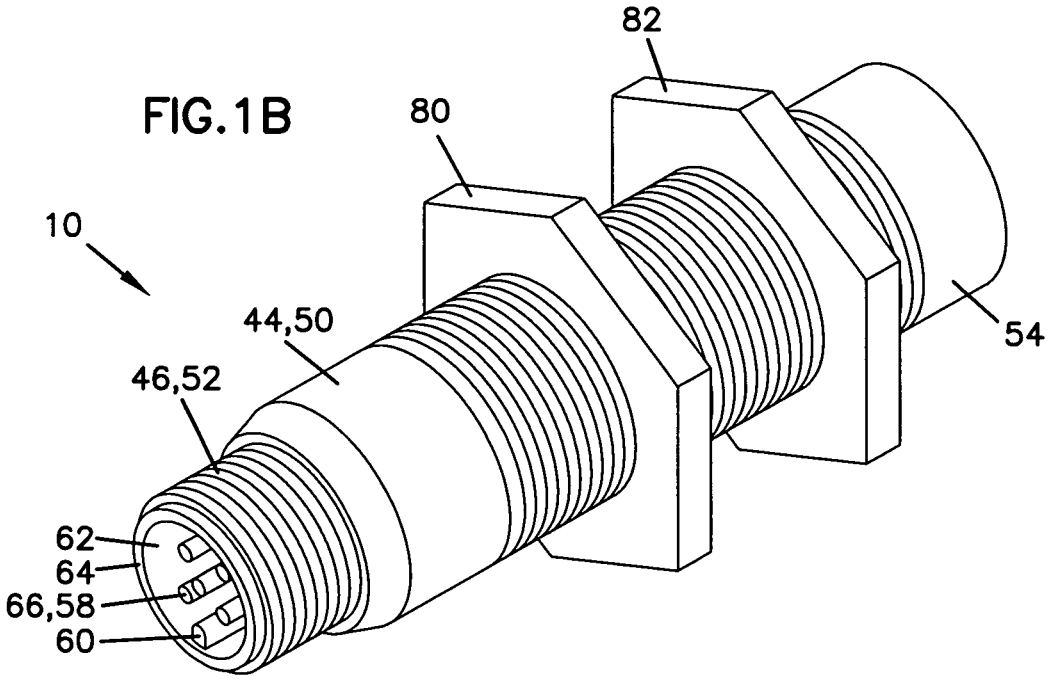
FIG. 1B is a perspective view of an indicator device with mounting hardware, according to an exemplary embodiment of the present disclosure.
Figure 2:
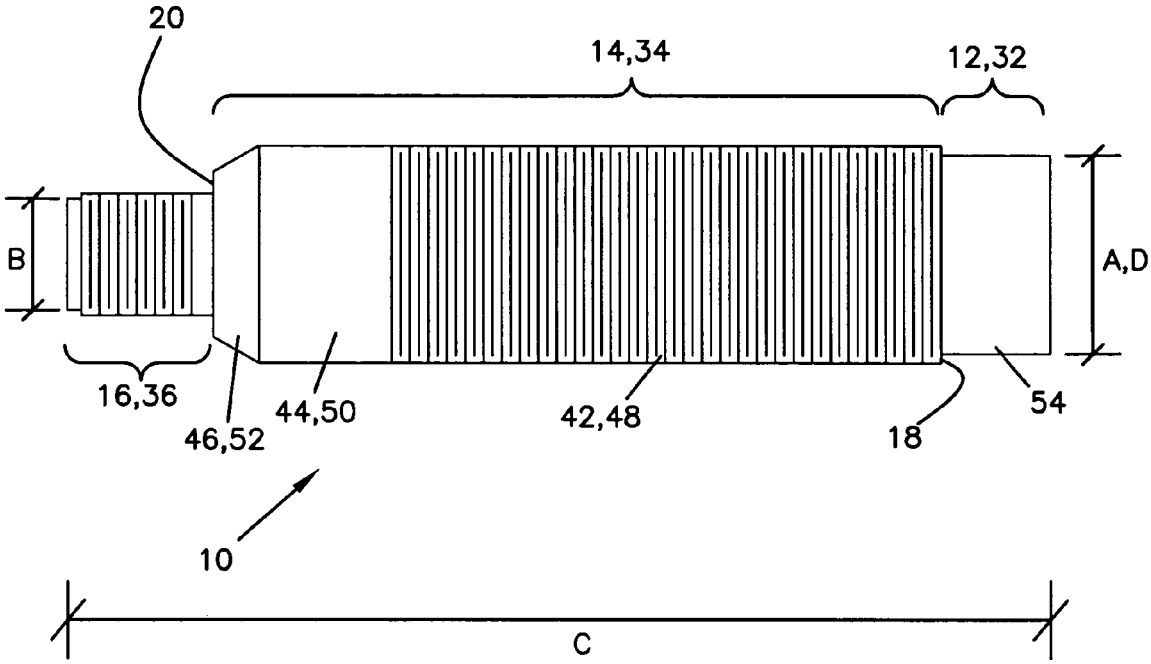
FIG. 2 is a side view of the indicator device of FIG. 1B without the mounting hardware, according to an exemplary embodiment of the present disclosure.

FIG. 1B is a perspective view of an indicator device 10, according to one example embodiment. FIG. 2 is a side view of the indicator device 10. Referring to FIGS. 1B and 2, preferably, the indicator device 10 includes a first section 12, a second section 14, and a third section 16. The first section 12, the second section 14, and the third section 16 can be integrally formed or be three distinct pieces, or some combination thereof.

The second section 14 includes a first end 18 and an opposite second end 20. The first section 12 is connected to the first end 18 of the second section. The third section 16 is connected to the second end 20 of the second section 14. Preferably, the first section 12 is an indicator section 32 for indicating a signal. The second section 14 is a mounting section 34 for mounting the indicator device 10. The third section 16 is a connector section 36 for connecting the indicator device 10.

The second section includes a first portion 42, a second portion 44, and a third portion 46. Preferably, the first portion 42 is a threaded section 48 for mounting the indicator device 10. The second portion 44 is a non-threaded section 50. The third section 46 is a transition section 52. In one example embodiment, a label or other information may be affixed to the non-threaded section 50. The threaded section 48 and the non-threaded section 50 preferably have a diameter A of 0.125-2.0 inches, and typically have a diameter A of 0.625 inches. The transition section 52 provides a transition between the non-threaded section 50 and the connector section 36.

Preferably, the connector section 36 has a diameter B less than the diameter A of the threaded section 48 and the non-threaded section 50. Preferably, the diameter B of the connector section is between 0.10 and 1.0 inches, and typically is 0.50 inches. Preferably, the diameter B of the connector section 36 is sized to mate with standard connectors (not shown). The connector section 36 is threaded to allow for a secure link to the connection inputs.

Preferably, the overall length C of the indicator device 10 is between 1 and 10 inches, and is typically 2.75 inches.

Figure 3:
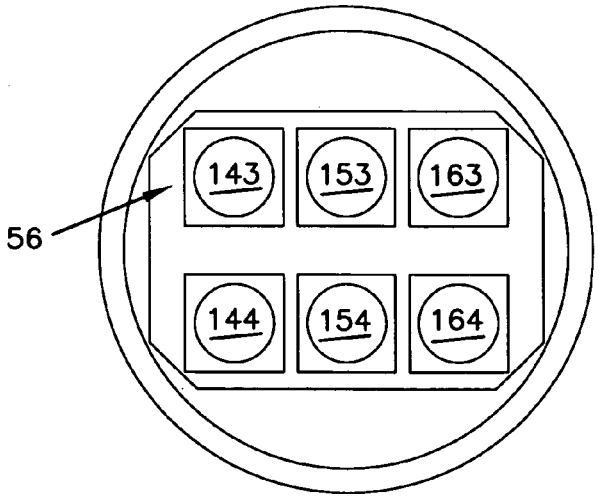
FIG. 3 is an end view of the indicator device of FIG. 1B with a piece removed, according to an exemplary embodiment of the present disclosure.

The indicator section 32 includes a cap 54. The cap 54 is generally opaque so that light emitted from a source inside the indicator section 32 might be visible through the cap 54. Of course, the cap 54 could also be clear. FIG. 3 illustrates an end view of an example embodiment of the indicator device 10 as viewed with the indicator section 32 oriented towards the viewer and the cap 54 removed. The indicator section 32 includes a plurality of light indicators 56 housed within the mounting section 34. These light indicators 56 are arranged near the cap 54 so that light emitted from these indicators 56 will illuminate through the cap 54. In this example embodiment, the light indicators 56 include two red LEDs 143, 144, two green LEDs 153, 154, and two yellow LEDs 163, 164. Of course, any combination of light colors or clear lights could also be used.

Figure 4:
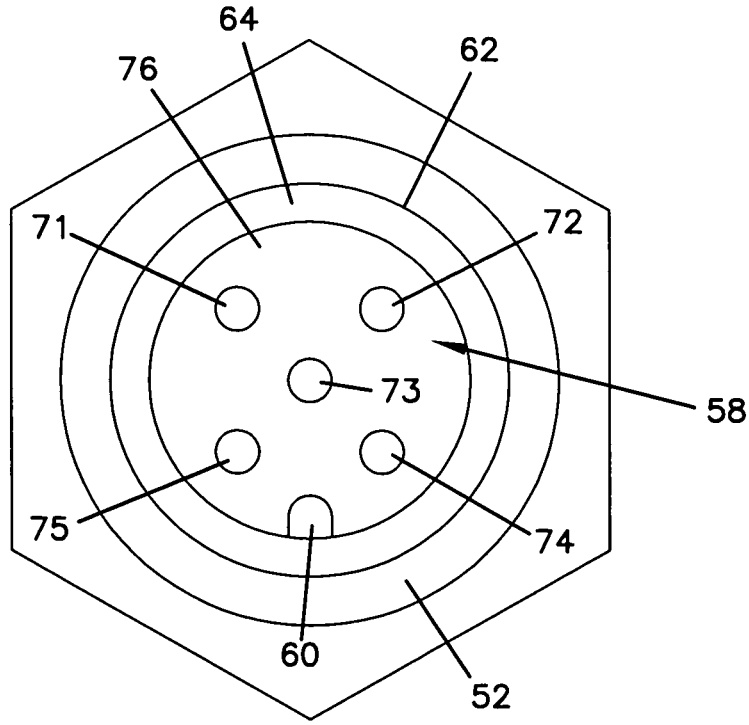
FIG. 4 is an end view of an indicator device, according to an exemplary embodiment of the present disclosure.

FIGS. 1 and 4 illustrate in more detail the connector section 36 of the indicator device 10. FIG. 1B illustrates a perspective view of the indicator device 10 with the connector section 36 oriented towards the viewer. FIG. 4 depicts an end view of one example embodiment of the indicator device 10 with the connector section 36 oriented towards the viewer. The connector section 36 is arranged and configured to attach to an input element (not shown) having a plurality of slots, an alignment notch, and a threaded inner surface.

The connector section 36 includes a plurality of input prongs 58, a tab 60, and an insert 62. Preferably, the insert 62 is manufactured of a non-conductive material and serves to insulate the input prongs 58 from the housing of the indicator device 10. The input prongs 58 extend through the insert 62 and into the mounting section 34. A first end 66 of each input prong 58 terminates before and does not extend past a lip 64 of the insert 62.

The first end 66 of each input prong 58 is arranged and configured to engage with an input element (not shown). The tab 60 is arranged and configured to align the input element for engagement with the input prongs 58. The input element then securely mounts to the connected section 36 via the threads provided around the periphery of the connector section 36. A second end (not shown) of each input prong 58 is arranged and configured such that it is in electrical communication with an LED of the indicator device 10.

Referring now to FIG. 4, preferably input prongs 58 include a first prong 71, a second prong 72, a third prong 73, a fourth prong 74, and fifth prong 75. The input prongs 71-75 and the alignment tab 60 can be seen enclosed within the lip 64 of the protective insert 62 in this example embodiment. Of course, any suitable number of input prongs can be used. The input prongs 71-75 and the alignment tab 60 extend perpendicular to a bottom surface 76 of the protective insert 60. The input prongs 71-75 extend through the bottom surface 76 of the protective insert 60. This bottom surface 76 is positioned inside of the connector section 36, spaced away from the lip 64. The transition section 52 of mounting section 34 is visible, extending out from the lip 64 of the insert 62.

Preferably, input prongs 71-75 are formed from a conductive material. In this example embodiment, one of the input prongs, for example, the third prong 73, provides a ground for the indicator device 10. The remaining input prongs 71, 72, 74, 75 are electrically coupled to the light indicators 56 illustrated in FIG. 3.

Referring back to FIG. 1B, the mounting section 34 preferably includes securing elements 80 and 82. The securing elements 80 and 82 are optionally coupled to the threaded section 48 of the mounting section 34 for mounting the indicator device 10 to an external object. Each securing element 80, 82 define a hole with a diameter D substantially similar to the diameter A of the threaded section 48 of the mounting section 34. The inner surfaces of each securing element 80, 82 are threaded for engagement with the threaded surface of the threaded section 48. Each securing element 80, 82 can be removed from either end 18, 20 of the threaded section 48 by spinning the element off the end of the threaded section 48.

One example of securing the indicator device 10 to an object is to remove the securing elements 80, 82 and then to partially slide the mounting section 36 through a hole in the surface of the object so that a portion of the threaded section 48 of the mounting section 36 protrudes from either side of the hole. The securing elements 80, 82 can then be spun onto the threaded section 48, one from each end 18, 20 of the mounting section 34, and positioned so as to clamp the surface between the securing elements 80, 82. The indicator device 10 can be mounted in this fashion to machines, wall displays, or other surfaces in a factory.

Figure 5:
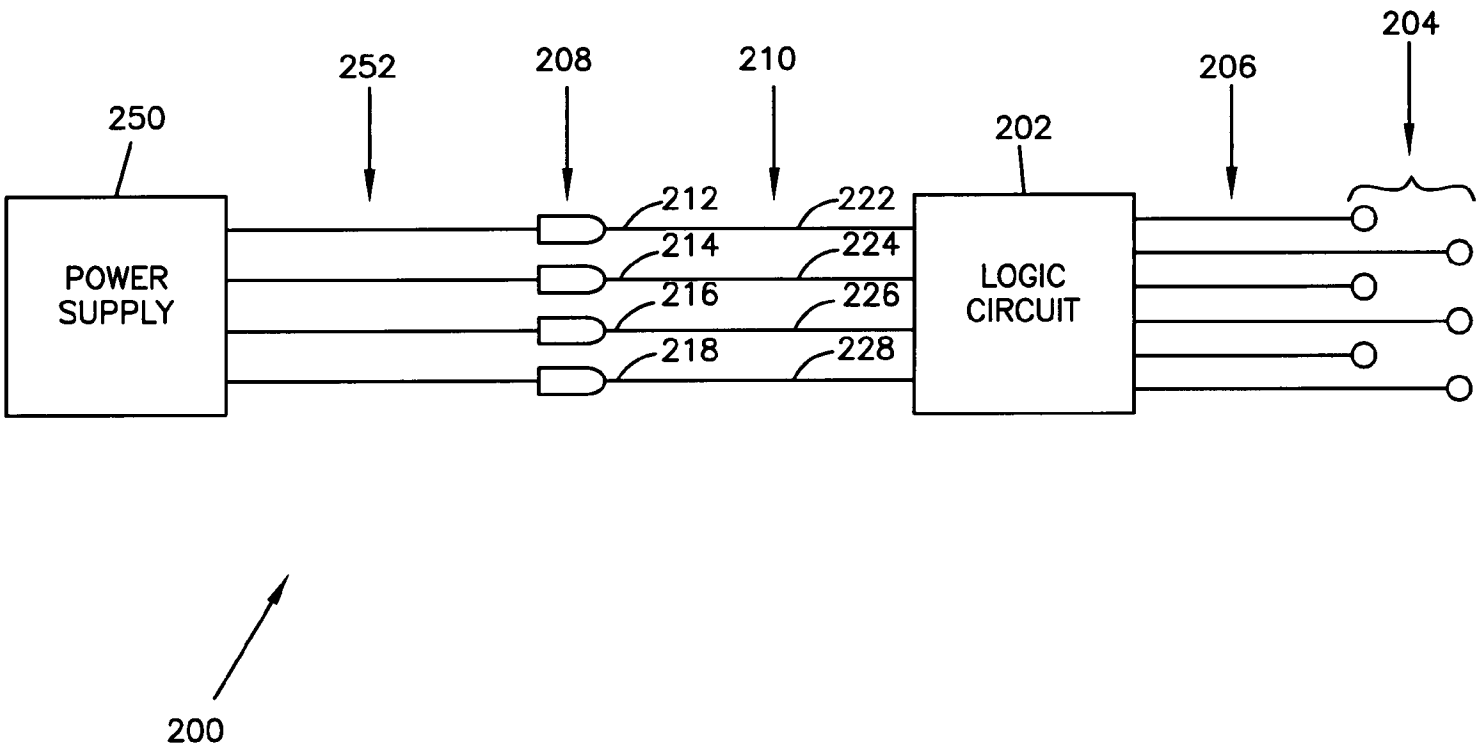
FIG. 5 is a schematic representation of an indicator device, according to an exemplary embodiment of the present disclosure.

FIG. 5 depicts an example system in which one embodiment of an indicator device 200, such as the indicator device 10 of FIGS. 1-4, can be used. The indicator device 200 includes a logic circuit 202. Preferably, the logic circuit 202 is housed within the indicator device 200, for example, the logic circuit 202 can be housed within the second section 14 of the indicator device 10 of FIGS. 1-4. The logic circuit 202 is arranged and configured to be electrically coupled to a plurality of indicators 204, such as the indicators 56 of FIG. 3, through a plurality of output lines 206.

The logic circuit 202 is further arranged and configured to be electrically coupled to a plurality of input prongs 208, such as the input prongs 71-75 of FIG. 4, through a plurality of input lines 210 from the input prongs 208. In this example embodiment, the plurality of input lines 210 include a first input signal 212, a second input signal 214, a third input signal 216, and a ground 218. Preferably, the first input signal 212 is a red input signal 222; the second input signal 214 is a green input signal 224; and the third input signal 216 is a yellow input signal 226. Of course, various combinations of these or other colors can be used depending on the desired light indicating effect. The input prongs 208 are in electrical communication with a power supply 250 through power transmission lines 252.

The logic circuit 202 generates different output signals 206 based on the input signals 210 it receives. Various combinations of input signals 210 each provide a different indicator effect. The indicator effect can be a light effect. The term "light effect" refers to causing the light indicators 204 to emit one or more colors of light, flash, alternate, dim, pulse, or perform some other such function. In this example embodiment, three input signals 212, 214, 216 are used. Therefore, seven light effects and one off state can be created, one for each permutation. In other words, the logic circuit 202 creates a different light effect for each of the following possible combinations of input signals 210 (212, 214, 216, 212+214, 214+216, 212+216, 212+214+216, NONE). Note that any suitable number of input signals 210 can be used. The total number of light effects that can be created is $2^n-1$, where n is the number of input signals 210.

Figure 6:
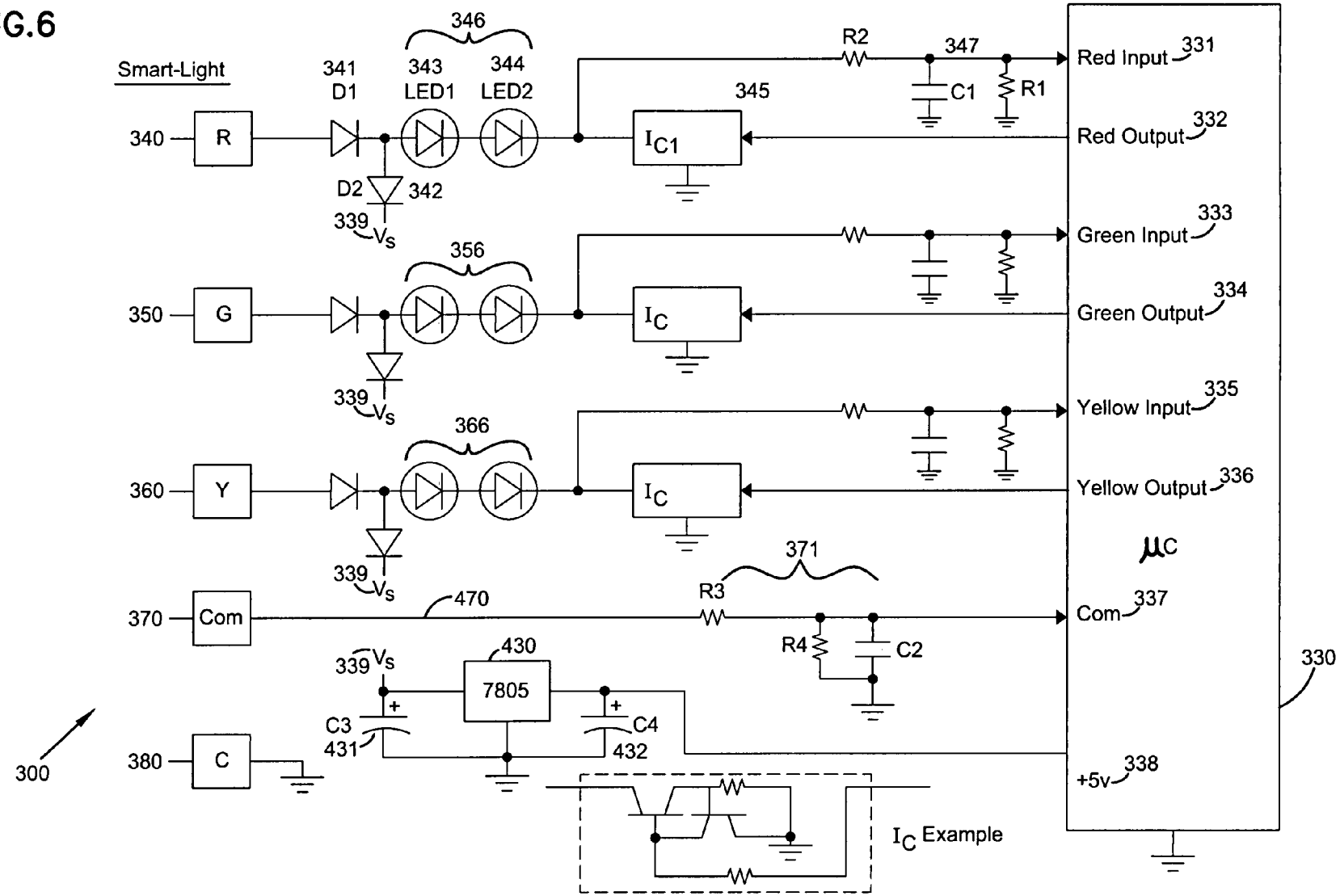
FIG. 6 is an electrical schematic of an indicator device, according to an exemplary embodiment of the present disclosure.

FIG. 6 illustrates an electrical schematic of one example embodiment of a logic circuit 300, such as the logic circuit 202 of FIG. 5, according to the present disclosure. In this example embodiment, the logic circuit 300 includes a microcontroller 330. The microcontroller 330 includes a red signal input 331 and an output 332, a green signal input 333 and an output 334, and a yellow signal input 335 and an output 336. The microcontroller 330 further includes a communications signal input 337 and a power input 338.

The power input 338 is supplied a voltage by a regulator 430 and filtering capacitors 431, 432 when a voltage is supplied to a power signal connector 339. In this embodiment, the regulator 430 is a five-volt regulator. Supplying the voltage allows the microcontroller 330 to supply a control output signal to at least one of the signal outputs 332, 334, 336. The circuitry connecting the red 340, green 350, and yellow 360 inputs to the microcontroller 330 are substantially similar. Therefore, only the circuitry connecting the red input 340 to the microcontroller 330 will be described in detail.

The red input 340 is first coupled to a reverse-polarity protection diode 341 in case the power supply polarity is reversed. Next, an arrangement of diodes 342 supply power to the power signal connector 339 of the microcontroller 330 whenever a voltage is applied to the red input 340. A voltage is also supplied to a red indicator 346. This red indicator 346 emits a red light when a voltage is applied to it. Generally, the indicator 346 includes an LED 343. It should be noted that any number of LEDs could be used depending on desired brightness and cost. In the example embodiment depicted in this figure, a second LED 344 is arranged in electrical communication with the first LED 343.

The voltage from the red input 340 is next supplied to the red signal input 331 of the microcontroller 330 through input protection elements 347. The input protection elements 347 are generally used to protect the microcontroller 330. A constant current source 345, which is configured to receive a voltage from the red signal output 332 of the microcontroller 330, is also arranged in electrical communication with the red indicator 346 such that the red indicator 346 will not emit light unless it receives power from the constant current source 345. The constant current source 345 will supply power to the red indicator 346 only if it receives a control signal from the red signal output 332 of the microcontroller 330.

Supplying power to any of the inputs 340, 350, or 360 will energize the regulator 430 and supply power to the power input 338. The microcontroller 330 supplies a control signal to the signal outputs 332, 334, 336 based on a program stored in the microcontroller 330. For example, supplying power only to the red signal input 331 can cause the microcontroller 330 to supply a control signal to only the red signal output 332. The constant current source 345, which is electrically coupled to the red signal output 332, will receive a voltage signal and therefore allow the red indicator 346 to emit light. However, these same input conditions could also cause the microcontroller 330 to supply a control signal intermittently to only the red signal output 332, causing the red indicator 346 to flash.

For another example, supplying power to both the red signal input 331 and the green signal input 333 could cause the microcontroller 330 to alternately provide a control signal to the red signal output 332 and the green signal output 334. This would cause the red indicator and the green indicator to alternately flash. However, these same input conditions could cause the microcontroller 330 to provide a control signal to both the red signal output 332 and the green signal output 334, causing both the red indicator 346 and the green indicator 356 to emit light simultaneously. When two or more light indicators of different colors emit light, a blended color light results. For example, the input signals suggested above would cause a cap, such as the cap 54 of FIG. 1B, to glow orange.

Still referring to FIG. 6, a communications channel 470 is formed between the communications input 370 and the communications signal input 337 of the microcontroller 330. The communications channel 470 generally also includes input protection elements 371 to protect the microcontroller 330. This communications channel 470 is generally used to reprogram the microcontroller 330 so that different light effects will result from the possible input combinations. The communications input 370 is configured so as to receive communication signals from an external device such as a remote computer or a Programmable Logic Controller (not shown). This allows the microcontroller 330 to be reprogrammed without opening and rewiring the indicator device.

Referring now to FIGS. 7-19, some block diagrams depicting other example embodiments of a logic circuit, such as logic circuit 202 of FIG. 5, according to the present disclosure are shown. In some example embodiments, a logic circuit includes a first pin, a second pin, a third pin, and a fourth pin. In other example embodiments, however, logic circuits can include from about two pins to about ten pins.

Figure 7:
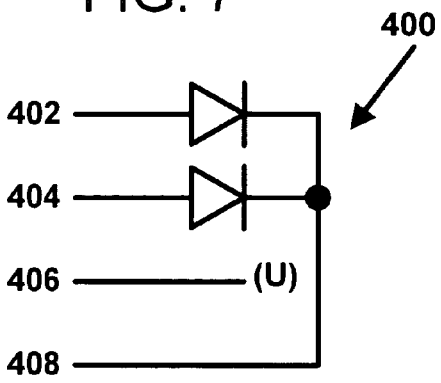
FIG. 7 is a block diagram of a logic circuit, according to an exemplary embodiment of the present disclosure.

FIG. 7 illustrates one example block diagram of one possible embodiment of a logic circuit 400. In this example embodiment, the first pin 402 is configured to cause the green indicator to emit light when supplied with electrical power and the second pin 404 is configured to cause the red indicator to emit light when supplied with electrical power. The third pin 406 is unused in this example embodiment and the fourth pin 408 is a communications channel. The logic circuit 400 is capable of performing up to seven light effects. In one example embodiment, the logic circuit 400 can be used with PNP sensors.

Figure 8:
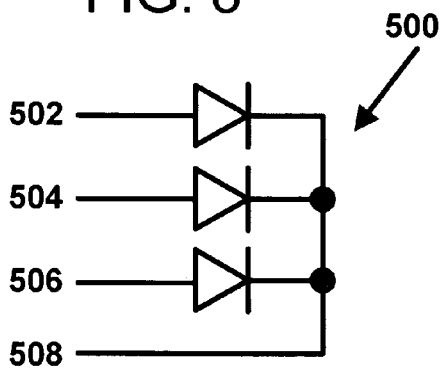
FIG. 8 is another block diagram of a logic circuit, according to an exemplary embodiment of the present disclosure.

FIG. 8 illustrates an example block diagram of another possible embodiment of a logic circuit 500. The logic circuit 500 includes four pins 502, 504, 506, 508.

Figure 9:
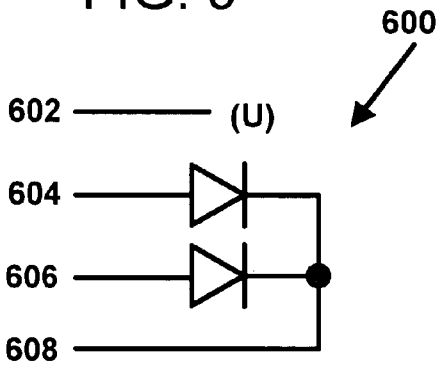
FIG. 9 is yet another block diagram of a logic circuit, according to an exemplary embodiment of the present disclosure.

FIG. 9 illustrates an example block diagram of yet another possible embodiment of a logic circuit 600. The logic circuit 600 includes four pins 602, 604, 606, 608.

Figure 10:
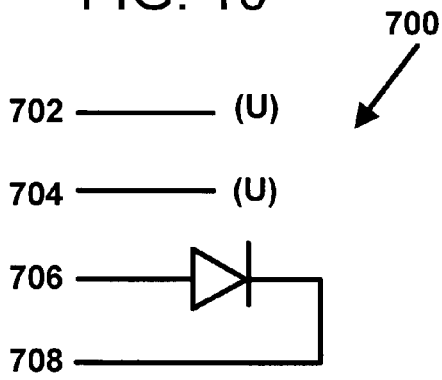
FIG. 10 is yet another block diagram of a logic circuit, according to an exemplary embodiment of the present disclosure.

FIG. 10 illustrates an example block diagram of yet another possible embodiment of a logic circuit 700. The logic circuit 700 includes four pins 702, 704, 706, 708.

Figure 11:
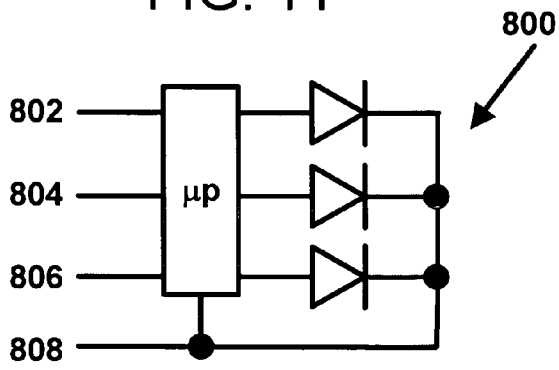
FIG. 11 is a block diagram of a logic circuit including a microcontroller, according to an exemplary embodiment of the present disclosure.

FIG. 11 illustrates an example block diagram of yet another possible embodiment of a logic circuit 800. The logic circuit 800 includes a microcontroller 810 and four pins 802, 804, 806, 808. In some example embodiments, the microcontroller 810 is configured to cause a corresponding indicator to emit light when power is applied to one of the first, second, and third pins 802, 804, 806 respectively. In one example embodiment, applying power to the third pin 806 causes the first and second indicator to emit light, thereby blending the colors of the first and second indicators.

In some example embodiments, the microcontroller 810 is further configured to cause one of the indicators to flash when supplying power simultaneously to two or more pins 802, 804, 806. For example, in one example embodiment, supplying power to the first pin 802 and the second pin 804 causes the first indicator to flash, whereas supplying power to the second and third pins 804, 806, respectively, causes the second indicator to flash. In other example embodiments, the logic circuit 800 is configured to cause the first and second indicators to alternately flash when power is supplied to the first and second pins 802, 804. In still other example embodiments, the logic circuit 800 is configured to sequentially flash the first, second, and third indicators in a rotating fashion when power is supplied to the first, second, and third pints 802, 804, 806, respectively.

Figure 12:
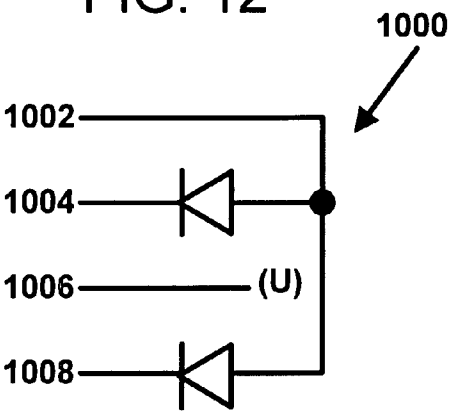
FIG. 12 is a block diagram of a logic circuit, according to an exemplary embodiment of the present disclosure.

FIG. 12 illustrates one example block diagram of one possible embodiment of a logic circuit 1000. In this example embodiment, the first pin 1002 is a communications channel and the second pin 1004 is configured to cause the red indicator to emit light when supplied with electrical power. The third pin 1006 is unused and the fourth pin 1008 is configured to cause the green indicator to emit light. In one example embodiment, the logic circuit 1000 can be used with NPN sensors.

Figure 13:
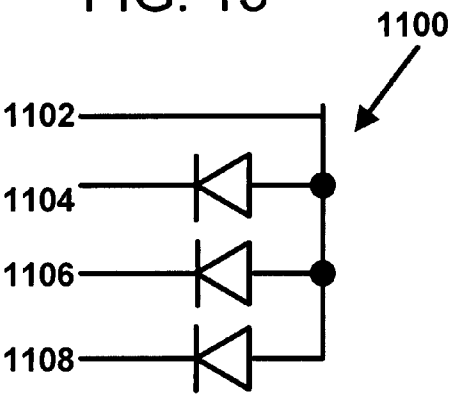
FIG. 13 is another block diagram of a logic circuit, according to an exemplary embodiment of the present disclosure.

FIG. 13 illustrates an example block diagram of another possible embodiment of a logic circuit 1100. The logic circuit 1100 includes four pins 1102, 1104, 1106, 1108.

Figure 14:
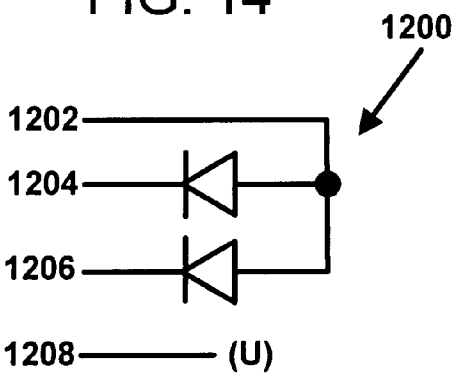
FIG. 14 is yet another block diagram of a logic circuit, according to an exemplary embodiment of the present disclosure.

FIG. 14 illustrates an example block diagram of yet another possible embodiment of a logic circuit 1200. The logic circuit 1200 includes four pins 1202, 1204, 1206, 1208.

Figure 15:
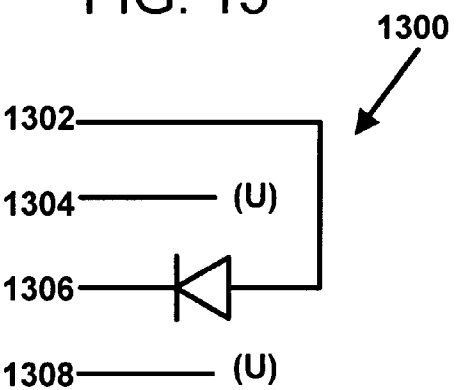
FIG. 15 is yet another block diagram of a logic circuit, according to an exemplary embodiment of the present disclosure.

FIG. 15 illustrates an example block diagram of yet another possible embodiment of a logic circuit 1300. The logic circuit 1300 includes four pins 1302, 1304, 1306, 1308.

Figure 16:
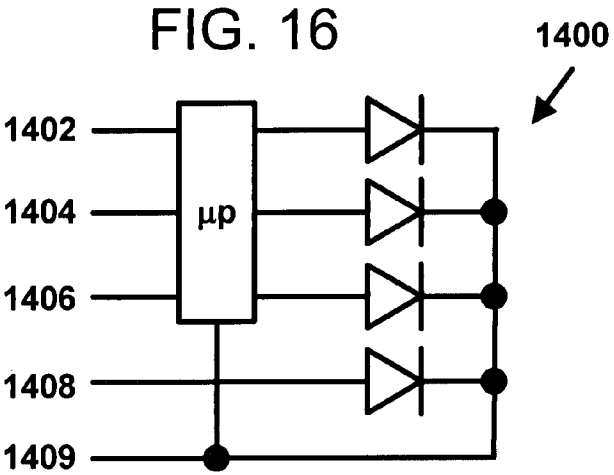
FIG. 16 is another block diagram of a logic circuit including a microcontroller, according to an exemplary embodiment of the present disclosure.

FIG. 16 illustrates an example block diagram of yet another possible embodiment of a logic circuit 1400. The logic circuit 1400 includes a microcontroller 1410 and five pins 1402, 1404, 1406, 1408, 1409. Four of the five pins 1402, 1404, 1406, 1408 are coupled to the microcontroller 1410. The logic circuit 1400 is capable of performing up to fifteen light effects.

In one example embodiment, the first four pins 1402, 1404, 1406, 1408 operate light indicators and the fifth pin 1409 is a communications channel. By having four pins 1402, 1404, 1406, 1408 operating light indicators, the logic circuit 1400 is configured to cause each indicator to emit light, to flash, and to flash alternately with at least one other indicator, and to sequentially flash with all four indicators.

Figure 17:
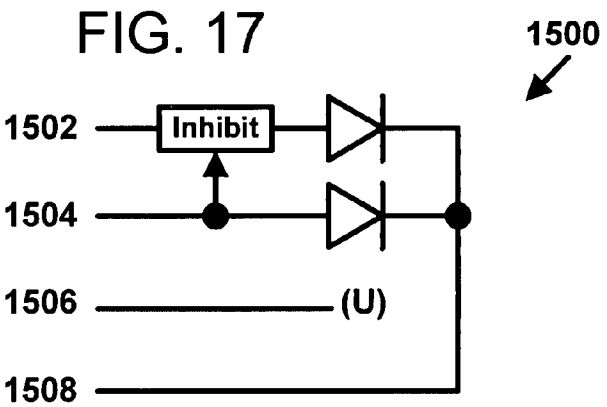
FIG. 17 is another block diagram of a logic circuit, according to an exemplary embodiment of the present disclosure.

FIG. 17 illustrates an example block diagram of yet another possible embodiment of a logic circuit 1500. The logic circuit 1500 includes four pins 1502, 1504, 1506, 1508. The second pin 1504 is configured to inhibit the first pin 1502. The third pin 1506 is unused and the fourth pin 1508 includes a communications channel.

Figure 18:
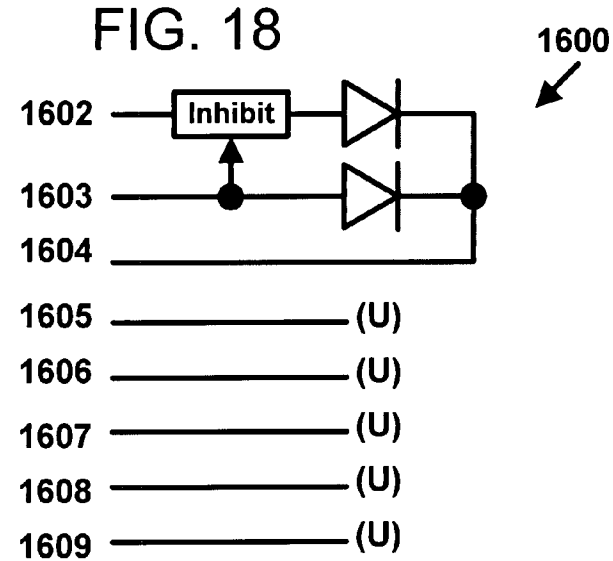
FIG. 18 is yet another block diagram of a logic circuit, according to an exemplary embodiment of the present disclosure.

FIG. 18 illustrates an example block diagram of yet another possible embodiment of a logic circuit 1600. The logic circuit 1600 includes eight pins 1602, 1603, 1604, 1605, 1606, 1607, 1608, 1609. The second pin 1603 is configured to inhibit the first pin 1602. The third pin 1604 is includes a communications channel and the remaining five pins 1605-1609 are unused in this embodiment.

Figure 19:
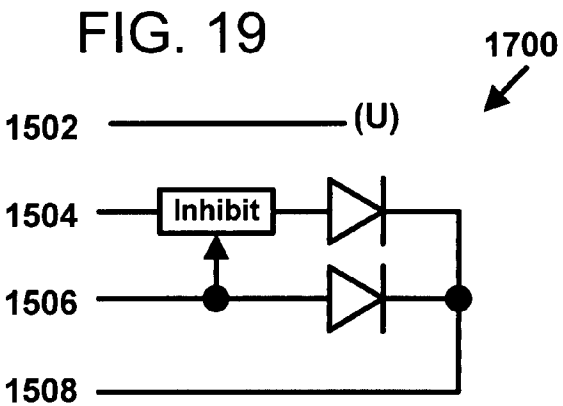
FIG. 19 is still another block diagram of a logic circuit, according to an exemplary embodiment of the present disclosure.

FIG. 19 illustrates an example block diagram of yet another possible embodiment of a logic circuit 1700. The logic circuit 1700 includes four pins 1702, 1704, 1706, 1708. The third pin 1706 is configured to inhibit the second pin 1704. The first pin 1702 is unused and the fourth pin 1708 includes a communications channel.

The invention claimed is:

1. A light indicator, comprising:

an indicator section configured to emit a plurality of light signals;

a control section operationally coupled to the indicator section, the control section configured to operate the indicator section based on one of a plurality of logic functions stored in the control section;

a communications section operationally coupled to the control section, the communications section configured to receive an input signal corresponding to one of the logic functions;

wherein the control section causes the indicator section to emit one of the plurality of light signals based on the logic function corresponding to the received input signal;

wherein the indicator section is configured to emit light of at least a first color and a second color;

wherein the control section causes the indicator section to emit light of a blended color, the blended color including the first color and the second color.

2. The light indicator of claim 1, wherein the control section is threaded.

3. The light indicator of claim 1, wherein the communications section is threaded.

4. The light indicator of claim 1, wherein the indicator section includes at least one light emitting diode.

5. The light indicator of claim 1, wherein the control section causes the indicator section to flash light of one color.

6. The light indicator of claim 1, wherein the control section causes the indicator section to flash alternately light of two or more colors.

7. The light indicator of claim 1, further comprising at least one securing element for mounting the light indicator to a surface.

8. The light indicator of claim 1, wherein the communications section is further configured to receive a program signal, wherein the program signal causes the control section to store a different plurality of logic functions.

9. The light indicator of claim 1, wherein the control section includes a logic circuit configured to store the plurality of logic functions.

10. A programmable light indicator, comprising:

a microcontroller configured to store a plurality of programs;

a plurality of input lines operationally coupled to the microcontroller for sending one of a plurality of input signals to the microcontroller, each input signal activating one of the plurality of programs stored in the microcontroller; and a plurality of light indicators, each light indicator operably coupled to the microcontroller for receiving a control signal from the microcontroller, the control signal causing the light indicator to emit one of a plurality of light functions;

wherein the microcontroller transmits the control signal to each light indicator based on the activated program;

wherein the plurality of light functions comprise emitting light, turning off, flashing light, and dimming.

11. The programmable light indicator of claim 10, wherein at least one of the plurality of programs stored in the microcontroller causes the microcontroller to transmit control signals to the plurality of indicators causing at least two light indicators to emit light simultaneously.

12. The programmable light indicator of claim 10, further comprising a communication line including a first end in communication with the microcontroller and a second end in communication with a program source.

13. The programmable light indicator of claim 12, wherein the program source can alter any of the programs stored in the microcontroller to change the control signals transmitted to the light indicators when the program is activated.

14. The programmable light indicator of claim 12, wherein the program source is an external computer.

15. The programmable light indicator of claim 12, wherein the program source is an external Programmable Logic Controller.

16. A programmable light indicator, comprising:

a microcontroller configured to store a plurality of programs;

a plurality of input lines operationally coupled to the microcontroller for sending one of a plurality of input signals to the microcontroller, each input signal activating one of the plurality of programs stored in the microcontroller; and a plurality of light indicators, each light indicator operably coupled to the microcontroller for receiving a control signal from the microcontroller, the control signal causing the light indicator to emit one of a plurality of light functions;

wherein the microcontroller transmits the control signal to each light indicator based on the activated program;

wherein at least one of the plurality of programs stored in the microcontroller causes the microcontroller to transmit control signals to the plurality of indicators causing at least two light indicators to emit light simultaneously;

wherein the microcontroller causes the light indicators to emit light of a blended color, the blended color including a first color and a second color.

17. The programmable light indicator of claim 16, further comprising a communication line including a first end in communication with the microcontroller and a second end in communication with a program source.

18. The programmable light indicator of claim 17, wherein the program source can alter any of the programs stored in the microcontroller to change the control signals transmitted to the light indicators when the program is activated.

19. The programmable light indicator of claim 17, wherein the program source is an external computer.

20. The programmable light indicator of claim 17, wherein the program source is an external Programmable Logic Controller.

* * * * *